US009915426B2

(12) United States Patent
Kim

(10) Patent No.: US 9,915,426 B2
(45) Date of Patent: Mar. 13, 2018

(54) IMPINGING-TYPE TEMPERATURE UNIFORMITY DEVICE

(71) Applicant: Hanwha Techwin Co., Ltd., Changwon-si (KR)

(72) Inventor: Minki Kim, Changwon-si (KR)

(73) Assignee: Hanwha Techwin Co., Ltd., Changwon-Si (KR)

( * ) Notice: Subject to any disclaimer, the term of this patent is extended or adjusted under 35 U.S.C. 154(b) by 0 days.

(21) Appl. No.: 15/205,160

(22) Filed: Jul. 8, 2016

(65) Prior Publication Data

US 2017/0009984 A1 Jan. 12, 2017

(30) Foreign Application Priority Data

Jul. 8, 2015 (KR) ..... 10-2015-0097162

(51) Int. Cl.

| | |
|---|---|
| ***F15D 1/02*** | (2006.01) |
| ***F23N 3/00*** | (2006.01) |
| ***B01F 5/00*** | (2006.01) |
| ***F23J 15/00*** | (2006.01) |
| ***F23D 14/68*** | (2006.01) |

(52) U.S. Cl.

CPC ..... *F23N 3/007* (2013.01); *B01F 5/00* (2013.01); *F23D 14/68* (2013.01); *F23J 15/00* (2013.01); *F23L 2900/00* (2013.01); *F23L 2900/00001* (2013.01)

(58) Field of Classification Search

USPC ..... 138/39, 41, 42

See application file for complete search history.

(56) References Cited

U.S. PATENT DOCUMENTS 3,109,459 A * 11/1963 Lee, II ..... F15B 21/00 138/40
3,990,858 A * 11/1976 O'Sullivan ..... F15D 1/02 138/40
4,192,402 A * 3/1980 Nakagawa ..... F01N 1/04 181/256
4,418,722 A * 12/1983 Kendall ..... B01J 3/02 138/42
4,830,057 A * 5/1989 Hendrickson ..... F15D 1/0005 138/41
5,099,879 A * 3/1992 Baird ..... F15D 1/02 137/561 A
5,588,635 A * 12/1996 Hartman ..... F15D 1/04 138/44
6,000,433 A * 12/1999 Carroll ..... B01D 46/10 138/41

(Continued)

FOREIGN PATENT DOCUMENTS

| | | |
|---|---|---|
| EP | 1492617 B1 | 5/2010 |
| JP | 201163028 A | 3/2011 |
| KR | 100934716 B1 | 12/2009 |

*Primary Examiner* — James Hook

(74) *Attorney, Agent, or Firm* — Sughrue Mion, PLLC

(57) ABSTRACT

An impinging-type temperature uniformity device includes an outer case portion; and a temperature uniformizer provided in the outer case portion, spaced apart inwardly from an inner surface of the outer case portion and connected to the outer case portion, wherein the temperature uniformizer includes: a head portion provided in the outer case portion; and a body portion spaced apart inwardly from the inner surface of the outer case portion and including at least one through-hole.

18 Claims, 3 Drawing Sheets

(56) References Cited

U.S. PATENT DOCUMENTS

| | | | | |
|---|---|---|---|---|
| 6,810,683 | B2 * | 11/2004 | Eustice | B60H 1/3229 138/41 |
| 2002/0104573 | A1 * | 8/2002 | Raftis | E02B 13/02 138/41 |
| 2003/0089410 | A1 * | 5/2003 | Young | F16L 55/053 138/30 |
| 2007/0138162 | A1 | 6/2007 | Tonomura et al. | |
| 2008/0099093 | A1 * | 5/2008 | Young | F16L 55/054 138/30 |

* cited by examiner

IMPINGING-TYPE TEMPERATURE UNIFORMITY DEVICE

CROSS-REFERENCE TO RELATED APPLICATION

This application claims priority from Korean Patent Application No. 10-2015-0097162, filed on Jul. 8, 2015, in the Korean Intellectual Property Office, the disclosure of which is incorporated herein by reference in its entirety.

BACKGROUND

1. Field

Apparatuses consistent with exemplary embodiments relate to a device, and more particularly, to an impinging-type temperature uniformity device.

2. Description of the Related Art

In the related art, an external device using a gas such as a compressor, a burner, or a cooling device may receive or eject a gas having a temperature different from room temperature. The temperature of the gas supplied to or ejected from such external device may vary based on the external device performance and the temperature of the gas supplied to or ejected from the external device may affect the performance of another device connected to the external device. In addition, when the temperature of the gas supplied to the external device is varies, the temperature in the external device receiving the gas also varies, thereby reducing a lifespan of the external device.

In order to solve these problems, a technology for bending a path of a gas generated after a burning process in a burner has been developed and disclosed in, for example, Japanese Patent Publication No. 2011-063028.

SUMMARY

One or more exemplary embodiments include an impinging-type temperature uniformity device.

Additional aspects will be set forth in part in the description which follows and, in part, will be apparent from the description, or may be learned by practice of the presented embodiments.

According to an aspect of an exemplary embodiments, there is provided an impinging-type temperature uniformity device including: an outer case portion defining an outer appearance; a temperature uniformizer spaced apart from an inner surface of the outer case portion and connected to the outer case portion, wherein the temperature uniformizer includes: a head portion in the outer case portion; and a body portion integrally formed with the head portion and including an outer surface spaced apart from the inner surface of the outer case portion and in which at least one through-hole is formed.

The head portion may have a curved shape.

The at least one through-hole may include a plurality of through-holes, wherein the plurality of through-holes are symmetric with respect to a center of the body portion.

The temperature uniformizer may further include a connecting portion connecting the body portion to the outer case portion.

The head portion may be on an upstream side in a direction in which a gas passing through an inside of the outer case portion flows.

A total area of the at least one through-hole may be equal to or less than 30% and equal to or greater than 10% of an area of a cross-section of the outer case portion in a direction perpendicular to a longitudinal direction.

A size of a cross-section of the body portion in a direction perpendicular to a longitudinal direction may be equal to or less than 30% and equal to or greater than 10% of a size of a cross-section of the outer case portion in a direction perpendicular to the longitudinal direction.

The body portion may include a second body portion connected to the outer case portion.

The second body portion may be bent.

The at least one through-hole may be formed in a portion of the body portion other than the second body portion.

A plurality of the through-holes may be formed, wherein a predetermined angle is formed between adjacent through-holes from among the plurality of through-holes with respect to a center of a cross-section of the body portion in a direction perpendicular to a longitudinal direction of the body portion.

The predetermined angle formed between the adjacent through-holes from among the plurality of through-holes with respect to the center of the cross-section of the body portion may be equal to or greater than 6°.

The impinging-type temperature uniformity device may further include a speed uniformizer on the outer case portion.

The speed uniformizer may be on further downstream side than the temperature uniformizer in a direction in which a gas flows.

According to an aspect of an exemplary embodiments, there is provided an impinging-type temperature uniformity device including: an outer case portion; a temperature uniformizer provided in the outer case portion, spaced apart inwardly from an inner surface of the outer case portion and connected to the outer case portion, wherein the temperature uniformizer includes: a head portion provided in the outer case portion; and a body portion spaced apart inwardly from the inner surface of the outer case portion and having at least one through-hole.

The head portion may have a curved shape.

The at least one through-hole may include a plurality of through-holes, and a first through-hole and a second through-hole of the plurality of through-holes may be symmetric to each other with respect to a center of the body portion.

The temperature uniformizer may further include a connecting portion connecting the body portion to the outer case portion.

The head portion may be provided at a first end of the temperature uniformizer along a longitudinal direction of the impinging-type temperature uniformity device, and the connecting portion may be provided at a second end opposite to the first end of the temperature uniformizer along the longitudinal direction of the impinging-type temperature uniformity device.

The head portion may be provided at an upstream side along a flow direction of a gas passing through an inside of the outer case portion.

A total area of the at least one through-hole may be less than or equal to 30% of an area of a cross-section of the outer case portion and greater than or equal to 10% of the area of the cross-section of the outer case portion, the area of the cross-section of the outer case portion being taken in a direction perpendicular to a longitudinal direction of the impinging-type temperature uniformity device.

A size of a cross-section of the body portion taken in a direction perpendicular to a longitudinal direction may be greater than or equal to 10% and less than or equal to 30% of a cross-sectional area of the outer case portion taken in the direction perpendicular to the longitudinal direction.

The body portion may include a connecting body portion connected to the outer case portion.

The connecting body portion may be bent with respect to the body portion.

The at least one through-hole may be provided in a portion of the body portion excluding the connecting body portion.

The at least one through-hole may include a plurality of through-holes, and a predetermined angle may be formed between adjacent through-holes from among the plurality of through-holes with respect to a center of a cross-section of the body portion taken in a direction perpendicular to a longitudinal direction of the body portion.

The predetermined angle formed between the adjacent through-holes from among the plurality of through-holes with respect to the center of the cross-section of the body portion may be greater than or equal to 6°.

The impinging-type temperature uniformity device may further include a speed uniformizer provided on the outer case portion.

The speed uniformizer may be provided on a downstream side from the temperature uniformizer in a gas flow direction.

The body portion of temperature uniformizer may be integrally formed with the head portion of temperature uniformizer.

The temperature uniformizer may further include a diverging portion including: a first end connected the body portion; and a second end opposite to the first end connected to the outer case portion.

A cross-sectional area of the temperature uniformizer at the first end may be smaller than a cross-sectional area of the temperature uniformizer at the second end.

The at least one through-hole may be provided at an upstream side of the diverging portion.

The at least one through-hole may include a plurality of through-holes.

BRIEF DESCRIPTION OF THE DRAWINGS

The above and/or other aspects of the disclosure will become apparent and more readily appreciated from the following description of the embodiments, taken in conjunction with the accompanying drawings in which.

DETAILED DESCRIPTION

The inventive concept now will be described more fully hereinafter with reference to the accompanying drawings, in which elements of the inventive concept are shown. The inventive concept may, however, be embodied in many different forms and should not be construed as limited to the exemplary embodiments set forth herein. Rather, these exemplary embodiments are provided so that this disclosure will be thorough and complete, and will fully convey the scope of the inventive concept to one of ordinary skill in the art. Meanwhile, the terminology used herein is for the purpose of describing exemplary embodiments only and is not intended to be limiting of exemplary embodiments. As used herein, the singular forms "a", "an" and "the" are intended to include the plural forms as well, unless the context clearly indicates otherwise. It will be further understood that the terms "comprises" and/or "comprising" used herein specify the presence of stated elements, steps, operations, and/or devices, but do not preclude the presence or addition of one or more other elements, steps, operations, and/or devices thereof. It will be understood that, although the terms first, second, etc. may be used herein to describe various elements, these elements should not be limited by these terms. These terms are only used to distinguish one element from another.

As used herein, the term "and/or" includes any and all combinations of one or more of the associated listed items. Expressions such as "at least one of," when preceding a list of elements, modify the entire list of elements and do not modify the individual elements of the list.

Figure 1:
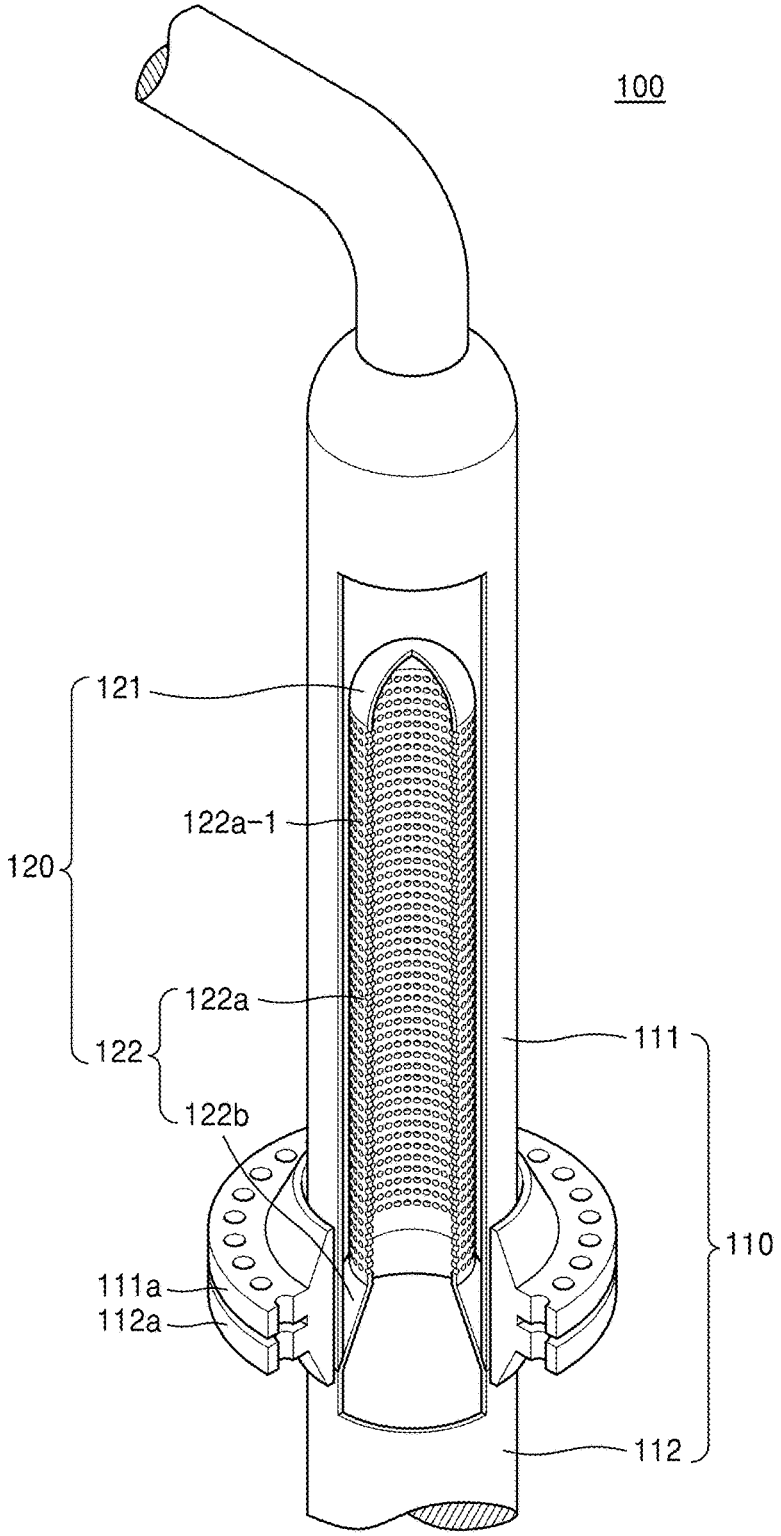
FIG. 1 is a perspective view of an impinging-type temperature uniformity device according to an exemplary embodiment.
Figure 2:
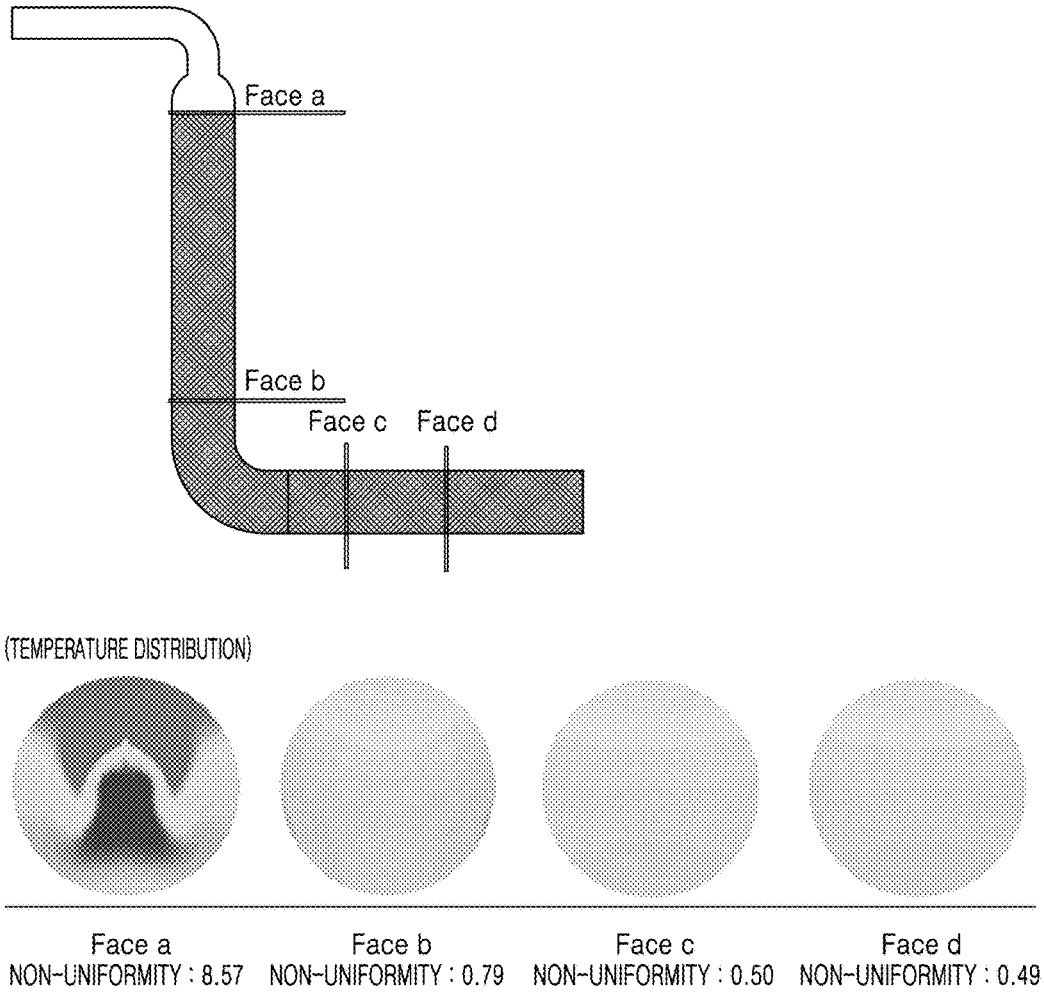
FIG. 2 is a view illustrating a flow analysis result of a pipe of the related art.
Figure 3:
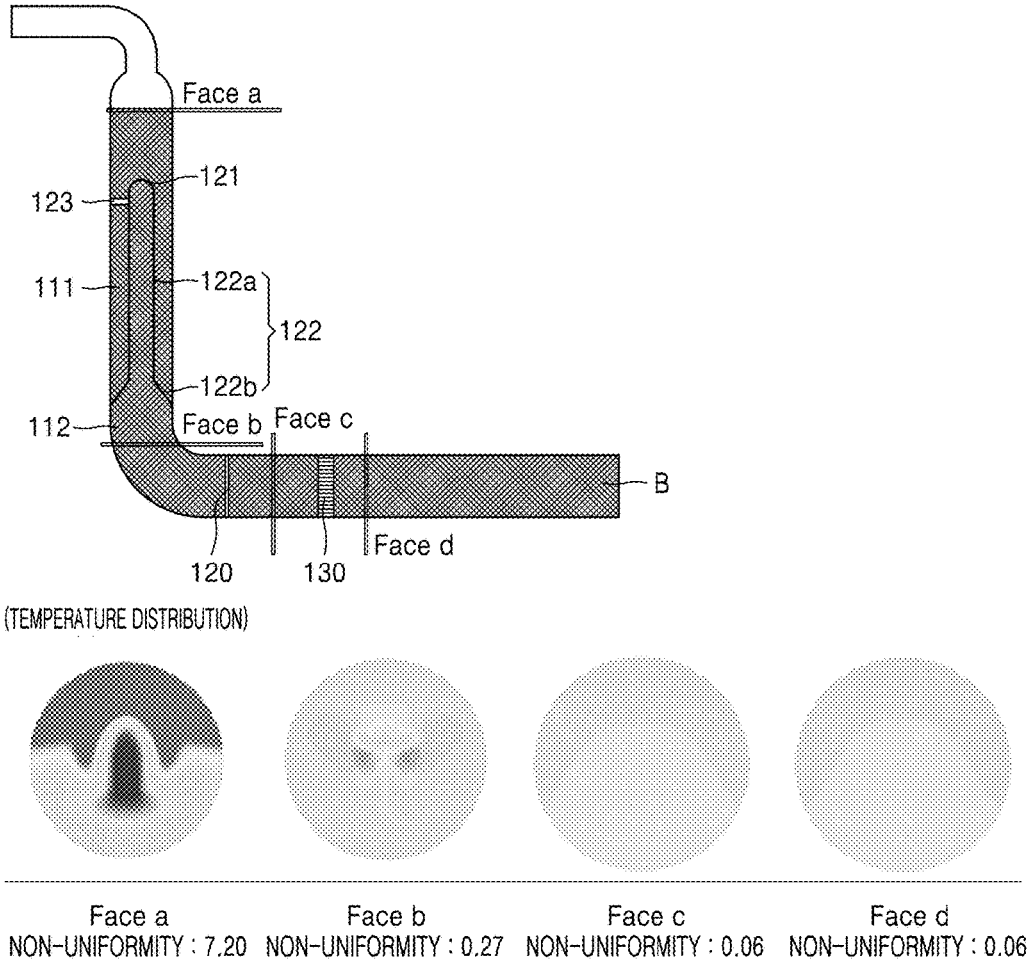
FIG. 3 is a view illustrating a flow analysis result of a pipe including the impinging-type temperature uniformity device of FIG. 1.

FIG. 1 is a perspective view of an impinging-type temperature uniformity device 100 according to an exemplary embodiment. FIG. 2 is a view illustrating a flow analysis result of a pipe of the related art. FIG. 3 is a view illustrating a flow analysis result of a pipe including the impinging-type temperature uniformity device 100 of FIG. 1.

Referring to FIGS. 1 through 3, the impinging-type temperature uniformity device 100 may include an outer case portion 110 and a temperature uniformizer 120. In the exemplary embodiment, the outer case portion 110 and the temperature uniformizer 120 may form a pipe shape. In particular, a cross-section of at least one of the outer case portion 110 and the temperature uniformizer 120 taken in a direction perpendicular to a longitudinal direction of the outer case portion 110 and the temperature uniformizer 120 may have any of various shapes. For example, the cross-section of at least one of the outer case portion 110 and the temperature uniformizer 120 taken perpendicular to the longitudinal direction may have any of various shapes, for example, a circular shape, an elliptical shape, or a polygonal shape. However, for convenience of explanation, the following will be explained on the assumption that the cross-section of at least one of the outer case portion 110 and the temperature uniformizer 120 taken perpendicular to the longitudinal direction may have a circular shape.

The outer case portion 110 may include a first outer case portion 111 and a second outer case portion 112. In the exemplary embodiment, the first outer case portion 111 and the second outer case portion 112 may be detachably connected to each other. In particular, when the temperature uniformizer 120 is damaged or deformed, the temperature uniformizer 120 may be easily replaced by separating the first outer case portion 111 from the second outer case portion 112. Also, because the first outer case portion 111 and the second outer case portion 112 may be separated from each other, the temperature uniformizer 120 may be easily installed in the impinging-type temperature uniformity device 100.

The first outer case portion 111 may include a first flange 111*a* that protrudes outward in a radial direction of the first outer case portion 111, and the second outer case portion 112 may include a second flange 112*a* that protrudes outward in the radial direction of the second outer case portion 112.

Holes into which an additional fastening member (not shown) such as screws or bolts may be inserted may be formed in each of the first flange 111*a* and the second flange 112*a*. In the exemplary embodiment, the first flange 111*a* and the second flange 112*a* may be coupled to each other by welding. However, for convenience of explanation, the following will be explained on the assumption that the first flange 111*a* and the second flange 112*a* are fixed to each other by the fastening member.

The temperature uniformizer 120 may include a head portion 121, a body portion 122, and a connecting portion 123. The shape of the head portion 121 is not particularly limited. For example, the head portion 121 may have a flat panel shape. In another example, the head portion 121 may have a curved shape. In particular, the head portion 121 may have a hemispherical shape, an elliptical shape, or an air-foil shape. For convenience of explanation, the following will be explained on the assumption that the head portion 121 has a curved shape.

The head portion 121 may be disposed on an upstream side in a direction in which a gas flows (referred to as a flow direction). In the exemplary embodiment, a fluid may collide with the head portion 121 and the head portion 121 may guide the fluid between the body portion 122 and the outer case portion 110.

The body portion 122 may be integrally formed with the head portion 121. In the exemplary embodiment, the body portion 122 may have a pipe shape (i.e., a cylindrical shape) and may be disposed in the outer case portion 110.

The body portion 122 may include a first body portion 122*a* that extends in the same direction as the longitudinal direction of the outer case portion 110. In the exemplary embodiment, a distance between the first body portion 122*a* and the outer case portion 110 (i.e., in a radial direction of the impinging-type temperature uniformity device 100) may be constant in the longitudinal direction of the first body portion 122*a*.

The first body portion 122*a* may be formed to have a shape similar to that of the outer case portion 110. In the exemplary embodiment, a size of a cross-section of the first body portion 122*a* taken perpendicular to the longitudinal direction may be smaller than a size of a cross-section of the outer case portion 110 taken perpendicular to the longitudinal direction. In particular, the size of the cross-section of the first body portion 122*a* taken perpendicular to the longitudinal direction may be equal to or less than 30% and greater than or equal to 10% of the size of the corresponding cross-section of the outer case portion 110 taken perpendicular to the longitudinal direction. In the exemplary embodiment, if the size of the cross-section of the first body portion 122*a* exceeds 30% of the size of the cross-section of the outer case portion 110, the flow of a gas may be disturbed, thereby increasing a pressure in the outer case portion 110. When the pressure of the outer case portion 110 is increased, at least one of the outer case portion 110 and the temperature uniformizer 120 may be deformed. In addition, if the size of the cross-section of the first body portion 122*a* exceeds 30% of the size of the cross-section of the outer case portion 110, the first body portion 122*a* is too large and thus the flow of a gas may be disturbed, thereby preventing the gas from flowing uniformly. In particular, when the gas does not flow uniformly, it is impossible for gases to be mixed in various directions, thereby failing to achieve gas temperature uniformity. Also, if the size of the cross-section of the first body portion 122*a* is under 10% of the size of the cross-section of the outer case portion 110, a pressure difference between an upstream side and a downstream side of the impinging-type temperature uniformity device 100 occurs, thereby applying an excessive pressure to the outer case portion 110 and the temperature uniformizer 120 and increasing a pressure loss of the gas supplied to the outside. Accordingly, the size of the cross-section of the first body portion 122*a* (taken perpendicular to the longitudinal direction) needs to be equal to or less than 30% and greater than or equal to 10% of the size of the cross-section of the outer case portion 110 (taken perpendicular to the longitudinal direction).

At least one through-hole 122*a*-1 may be formed in the first body portion 122*a*. In the exemplary embodiment, the through-hole 122*a*-1 may be drilled in such a way that the extending direction of the through-hole 122*a*-1 crosses the center of the cross-section of the first body portion 122*a* taken in a direction perpendicular to the longitudinal direction.

A plurality of the through-holes 122*a*-1 may be formed in a surface of the first body portion 122*a* to be spaced apart from one another by a predetermined interval. In particular, a distance between adjacent through-holes 122*a*-1 may be constant. In this case, a predetermined angle may be formed between adjacent through-holes 122*a*-1 from among the plurality of through-holes 122*a*-1 with respect to the center of the cross-section of the first body portion 122*a* in a direction perpendicular to the longitudinal direction. In particular, the angle between adjacent through-holes 122*a*-1 may be equal to or greater than 6°. In this case, if the angle between adjacent through-holes 122*a*-1 exceeds 6°, too many through-holes 122*a*-1 may be formed, and thus, strength of the temperature uniformizer 120 may be reduced.

Also, a total area of the plurality of through-holes 122*a*-1 may be equal to or less than 30% of an area of the cross-section of the outer case portion 110 perpendicular to the longitudinal direction. In this case, if the total area of the plurality of through-holes 122*a*-1 exceeds 30% of the area of the cross-section of the outer case portion 110 in a direction perpendicular to the longitudinal direction, the structural strength of the temperature uniformizer 120 may be reduced and speeds of gases may not be reduced, thereby failing to uniformly mix the gases.

The body portion 122 may include a second body portion 122*b* that is bent outwardly in a radial direction of the temperature uniformizer 120 from the first body portion 122*a* and is connected to the outer case portion 110. In this case, the second body portion 122*b* may be fixed to the second outer case portion 112 by welding or the like.

The connecting portion 123 may be disposed between the body portion 122 and the outer case portion 110 and may connect the body portion 122 and the outer case portion 110. In the exemplary embodiment, when a gas flows in the outer case portion 110, the connecting portion 123 may prevent the body portion 122 from being shaken or a position of the body portion 122 from being shifted due to a pressure of the gas.

The connecting portion 123 may be formed to have a bar shape. In the exemplary embodiment, a plurality of the connecting portions 123 may be provided, and may be arranged to be spaced apart from one another by a predetermined interval in the longitudinal direction or the circumferential direction of the body portion 122.

The impinging-type temperature uniformity device 100 may include a speed uniformizer 130 on the outer case portion 110. In this case, the speed uniformizer 130 may have a baffle shape or a mesh structure. The speed uniformizer 130 may uniformize a speed of a gas in the outer case portion 110 by causing the gas flowing through the outer case portion 110 to collide with the speed uniformizer 130.

The impinging-type temperature uniformity device 100 may be provided at any of various positions. For example, the impinging-type temperature uniformity device 100 may be provided in an ejecting flow path of a burner, a compressor, or a cooling device whose temperature is different from a room temperature or in a supplying flow path that supplies a gas to the burner, the compressor, or the cooling device. In this case, the impinging-type temperature uniformity device 100 may uniformize a temperature of a gas that passes through the impinging-type temperature uniformity device 100. In detail, when the impinging-type temperature uniformity device 100 is connected to the burner, the compressor, or the cooling device, the impinging-type temperature uniformity device 100 may be connected to a pipe B that guides a gas to the burner, the compressor, or the cooling device. In this case, the outer case portion 110 may be integrally formed with the pipe B, or may be separately formed and may be connected to the pipe B. However, for convenience of explanation, the following will be explained on the assumption that the outer case portion 110 is integrally formed with the pipe B. Also, the following will be explained on the assumption that the impinging-type temperature uniformity device 100 is provided in the supplier that supplies a gas to the burner or the like.

Once the burner operates, the burner may receive fuel and air and may convert chemical energy into heat energy therein. In this case, the performance of the burner may vary according to a temperature of the air supplied to the burner, and a temperature distribution of the burner may be made non-uniform. In particular, when a temperature of the air supplied to the burner is not uniform, the combustion performance of the burner may be degraded. When a temperature in the burner is continuously changed, a lifespan of the burner may be reduced.

However, because a temperature of air passing through the impinging-type uniformity device 100 according to the exemplary embodiment is made uniform, the above problems may be solved.

In detail, when air supplied to the burner is supplied through the outer case portion 110, the head portion 121 is disposed on an upstream side in a flow direction of a gas. In this case, the air flowing along the outer case portion 110 may collide with the head portion 121, and thus may be distributed between the body portion 122 and the outer case portion 110.

The distributed air may be supplied between the boy portion 122 and the outer case portion 110, and may be introduced into the body portion 122 through the plurality of through-holes 122*a*-1. In the exemplary embodiment, because the second body portion 122*b* closes a space between the outer case portion 110 and the first body portion 122*a*, the air having passed the head portion 121 may be all supplied into the first body portion 122*a* from between the first body portion 122*a* and the outer case portion 110 through the through-hole 122*a*-1.

The supplied air may pass through the plurality of through-holes 122*a*-1 and may be introduced into a central portion of the first body portion 122*a*. In the exemplary embodiment, because a pressure of the air between the first body portion 122*a* and the outer case portion 110 may be greater than a pressure of the air inside the first body portion 122*a*, the air may be introduced into the first body portion 122*a*.

The air having passed through the plurality of through-holes 122*a*-1 may be mixed in the first body portion 122*a*. In the exemplary embodiment, because the plurality of the through-holes 122*a*-1 are formed to face each other as described above, the air supplied from the through-holes 122*a*-1 formed to face each other may collide with each other and may be mixed with each other inside the first body portion 122*a*.

In this process, the air mixed in the first body portion 122*a* may be supplied to the outside or to another device through the second outer case portion 112. In this case, the air may pass through the second outer case portion 112 without much variation (i.e., uniformly) through this process.

In detail, referring to FIGS. 2 and 3, when air is supplied from a pipe of the related art, a non-uniformity of the air may be reduced to some extent after the air passes through the pipe of the related art. In this case, as the non-uniformity of the air is lower, a temperature of the air is made more uniform in a cross-section of a portion.

Referring to FIG. 2, as air moves, a temperature non-uniformity at a portion a (i.e., "Face a") in a pipe of the related art is 8.57. In this case, when the air continuously flows along the pipe of the related art, the temperature non-uniformity is gradually reduced to 0.79, 0.50, and 0.49 at a portion b (i.e., "Face b"), a portion c (i.e., "Face c"), and a portion d (i.e., "Face d"). However, referring to FIG. 3 illustrating the impinging-type temperature uniformity device 100 of the one or more exemplary embodiments, although a temperature non-uniformity at a portion a (i.e., "Face a") of the outer case portion 110 is 7.20, which is similar to the temperature non-uniformity of the pipe of the related art, the temperature non-uniformity is sharply reduced to 0.27 at a portion b (i.e., "Face b") after air passes through the impinging-type temperature uniformity device 100. In addition, the temperature non-uniformity is greatly reduced to 0.06 at Face c and at Face d while the air continuously passes the pipe B connected to the outer case 110.

Accordingly, the impinging-type temperature uniformity device 100 may uniformize a temperature of a gas with high temperature non-uniformity in the outer case portion 110. Also, the impinging-type temperature uniformity device 100 may supply a uniform gas to an external device, thereby improving the efficiency of the external device. The impinging-type temperature uniformity device 100 may uniformize a temperature of a gas ejected from the external device.

According to the one or more embodiments, a temperature of a gas may be made uniform and the uniform temperature gas may be supplied.

While exemplary embodiments have been particularly shown and described above, it will be understood by those of ordinary skill in the art that various changes in form and details may be made therein without departing from the spirit and scope of the inventive concept as defined by the following claims.

What is claimed is:

1. An impinging-type temperature uniformity device comprising:

an outer case portion;

a temperature uniformizer provided in the outer case portion, spaced apart inwardly from an inner surface of the outer case portion and connected to the outer case portion; and a speed uniformizer attached to the outer case portion at a downstream side from the temperature uniformizer in a gas flow direction, wherein the temperature uniformizer comprises:

a head portion provided in the outer case portion; and a body portion spaced apart inwardly from the inner surface of the outer case portion and comprising at least one through-hole, and wherein the speed uniformizer is attached to the outer case portion at an angle substantially perpendicular to the gas flow direction.

2. The impinging-type temperature uniformity device of claim 1, wherein the head portion has a curved shape.

3. The impinging-type temperature uniformity device of claim 1, wherein the at least one through-hole comprises a plurality of through-holes, and wherein a first through-hole and a second through-hole of the plurality of through-holes are symmetric to each other with respect to a center of the body portion.

4. The impinging-type temperature uniformity device of claim 1, wherein the temperature uniformizer further comprises a connecting portion connecting the body portion to the outer case portion.

5. The impinging-type temperature uniformity device of claim 1, wherein the head portion is provided at a first end of the temperature uniformizer along a longitudinal direction of the impinging-type temperature uniformity device, and wherein the connecting portion is provided at a second end opposite to the first end of the temperature uniformizer along the longitudinal direction of the impinging-type temperature uniformity device.

6. The impinging-type temperature uniformity device of claim 1, wherein the head portion is provided at an upstream side along a flow direction of a gas passing through an inside of the outer case portion.

7. The impinging-type temperature uniformity device of claim 1, wherein a size of a cross-section of the body portion taken in a direction perpendicular to a longitudinal direction is greater than or equal to 10% and less than or equal to 30% of a cross-sectional area of the outer case portion taken in the direction perpendicular to the longitudinal direction.

8. The impinging-type temperature uniformity device of claim 1, wherein the body portion comprises a connecting body portion connected to the outer case portion.

9. The impinging-type temperature uniformity device of claim 8, wherein the connecting body portion is bent with respect to the body portion.

10. The impinging-type temperature uniformity device of claim 8, wherein the at least one through-hole is provided in a portion of the body portion excluding the connecting body portion.

11. The impinging-type temperature uniformity device of claim 1, wherein the at least one through-hole comprises a plurality of through-holes, and wherein a predetermined angle is formed between adjacent through-holes from among the plurality of through-holes with respect to a center of a cross-section of the body portion taken in a direction perpendicular to a longitudinal direction of the body portion.

12. The impinging-type temperature uniformity device of claim 11, wherein the predetermined angle formed between the adjacent through-holes from among the plurality of through-holes with respect to the center of the cross-section of the body portion is greater than or equal to 6°.

13. The impinging-type temperature uniformity device of claim 1, wherein the body portion of temperature uniformizer is integrally formed with the head portion of temperature uniformizer.

14. The impinging-type temperature uniformity device of claim 1, wherein the temperature uniformizer further comprises a diverging portion comprising:

a first end connected the body portion; and a second end opposite to the first end connected to the outer case portion, and wherein a gas passing through the at least one through-hole from the outer case portion passes through the diverging portion.

15. The impinging-type temperature uniformity device of claim 14, wherein a cross-sectional area of the temperature uniformizer at the first end is smaller than a cross-sectional area of the temperature uniformizer at the second end.

16. The impinging-type temperature uniformity device of claim 14, wherein the at least one through-hole is provided at an upstream side of the diverging portion.

17. The impinging-type temperature uniformity device of claim 16, wherein the at least one through-hole comprises a plurality of through-holes.

18. An impinging-type temperature uniformity device comprising:

an outer case portion; and a temperature uniformizer provided in the outer case portion, spaced apart inwardly from an inner surface of the outer case portion and connected to the outer case portion, wherein the temperature uniformizer comprises:

a head portion provided in the outer case portion; and a body portion spaced apart inwardly from the inner surface of the outer case portion and comprising at least one through-hole, and wherein a total area of the at least one through-hole is less than or equal to 30% of an area of a cross-section of the outer case portion and greater than or equal to 10% of the area of the cross-section of the outer case portion, the area of the cross-section of the outer case portion being taken in a direction perpendicular to a longitudinal direction of the impinging-type temperature uniformity device.

* * * * *